US007563205B2

(12) United States Patent
Alling

(10) Patent No.: US 7,563,205 B2
(45) Date of Patent: Jul. 21, 2009

(54) TREADMILL WITH CUSHION ASSEMBLY

(75) Inventor: Jon C. Alling, Madison, WI (US)

(73) Assignee: Johnson Health Tech. Co., Ltd., Taichung Hsien (TW)

( * ) Notice: Subject to any disclaimer, the term of this patent is extended or adjusted under 35 U.S.C. 154(b) by 0 days.

(21) Appl. No.: 11/863,430

(22) Filed: Sep. 28, 2007

(65) Prior Publication Data

US 2009/0088301 A1 Apr. 2, 2009

(51) Int. Cl.
*A63B 22/02* (2006.01)

(52) U.S. Cl. ..... 482/54; 482/4; 482/908

(58) Field of Classification Search ..... 482/51, 482/54, 31; 198/843
See application file for complete search history.

(56) References Cited

U.S. PATENT DOCUMENTS

| | | | | | |
|---|---|---|---|---|---|
| 2,692,098 | A | * | 10/1954 | Schmued et al. | 244/104 R |
| 3,211,411 | A | * | 10/1965 | Rood | 248/566 |
| 3,300,209 | A | * | 1/1967 | Friis | 482/31 |
| 4,350,336 | A | | 9/1982 | Hanford | |
| 5,336,144 | A | | 8/1994 | Rodden | |
| 5,382,207 | A | * | 1/1995 | Skowronski et al. | 482/54 |
| 5,441,468 | A | | 8/1995 | Deckers et al. | |
| 5,827,155 | A | * | 10/1998 | Jensen et al. | 482/54 |
| 5,976,061 | A | | 11/1999 | Moon et al. | |
| 6,090,016 | A | * | 7/2000 | Kuo | 482/54 |
| 6,174,267 | B1 | * | 1/2001 | Dalebout et al. | 482/54 |
| 6,280,362 | B1 | * | 8/2001 | Dalebout et al. | 482/54 |
| 6,572,513 | B1 | | 6/2003 | Whan-Tong et al. | |
| 6,623,407 | B2 | | 9/2003 | Novak et al. | |
| 6,652,424 | B2 | * | 11/2003 | Dalebout | 482/54 |
| 6,716,669 | B2 | | 4/2004 | Erikson et al. | |
| 6,821,230 | B2 | * | 11/2004 | Dalebout et al. | 482/51 |
| 7,163,493 | B1 | * | 1/2007 | Kuo | 482/54 |
| 2003/0139261 | A1 | | 7/2003 | Kuo | |
| 2003/0153434 | A1 | | 8/2003 | Dalebout et al. | |
| 2004/0058786 | A1 | | 3/2004 | Nerio et al. | |
| 2006/0287163 | A1 | * | 12/2006 | Wang | 482/54 |

* cited by examiner

*Primary Examiner*—Fenn C Mathew
*Assistant Examiner*—Andrew M Tecco
(74) *Attorney, Agent, or Firm*—Michael Best & Friedrich LLP

(57) ABSTRACT

A treadmill including a frame, an endless belt having an upwardly-exposed exercise section, a deck disposed underneath the exercise section of the belt, and a cushion assembly positioned between the deck and the frame for providing cushion in order to reduce high impact loads on the user's body. The cushion assembly comprises a lever having a first portion that is operably coupled to the deck and a second portion that is rotatably coupled to the frame. The cushion assembly also comprises a resilient member coupled to both the lever and the frame so that the resilient member resists rotation of the lever as the lever is rotated. The elastic deformation of the resilient member provides resistance to displacement of the deck and therefore creates a cushion effect on the user's feet, ankles and knees as the user's feet contact the belt.

18 Claims, 8 Drawing Sheets

TREADMILL WITH CUSHION ASSEMBLY

BACKGROUND OF THE INVENTION

The present invention relates to a treadmill and, more particularly, to a treadmill with a cushion assembly.

Indoor exercise is getting more and more popular during recent decades. One popular indoor exercise apparatus is the treadmill. Treadmills commonly include a frame supported on the floor surface, and a console support extending upward from a front end of the frame. Two rollers are positioned at opposite ends of the frame, and an endless belt is trained on the rollers. A deck is positioned under the endless belt. A user may step on the endless belt for walking, running or other exercise purpose.

The upper portion of the belt is typically supported by the deck beneath the upper surface of the belt. The deck is usually composed of wood in order to provide the required support. Therefore, decks are commonly relatively rigid, which can result in high impact loads on the user's feet, ankles and knees as the user's feet contact the belt. These high impact loads are uncomfortable and further can result in unnecessary damage to joints as compared to running on a softer surface.

Because the typical treadmill has a very stiff, hard running surface and can become uncomfortable for extended periods of running, manufacturers have sought to make the running surface more resilient in an attempt to improve user comfort. While generally successful at reducing impact loads, these approaches have certain disadvantages. In particular, it has been found that there is a substantial advantage in being able to vary the stiffness of the decks in treadmills to accommodate the desires or running styles of different users. As a result there have been a number of attempts to provide mechanisms for varying deck stiffness, an example of which is as illustrated in U.S. Pat. No. 6,652,424. The '424 patent discloses a cushion system including a flexible cantilever, a bumper and a movable brace. The flexible cantilever has an end fixedly mounted on the frame by screws, and the bumper is fixedly attached to another end of the flexible cantilever. The brace is movable along the flexible cantilever.

SUMMARY OF THE INVENTION

The present invention provides a treadmill including a frame adapted to be supported on a floor surface, an endless belt having an upwardly-exposed exercise section, a deck disposed between the exercise section of the belt and the frame and a cushion assembly positioned between the deck and the frame for providing cushion in order to reduce high impact loads on the user's feet, ankles and knees. The cushion assembly comprises a lever having a first portion that is adapted to be rotated and a second portion that is rotatably coupled to the frame wherein the first portion of the lever is operably coupled to the deck. The cushion assembly also comprises a resilient member operably coupled to the lever and the frame wherein the resilient member resists rotation of the lever as the lever is being rotated. The elastic deformation of the resilient member could provide resistance to displacement of the deck and therefore create a cushion effect on the user's feet, ankles and knees as the user's feet contact the belt and the deck.

Another object of the present invention is to provide a cushioned treadmill which is capable of modifying the cushion of the treadmill to accommodate the desires or running styles of different users. The treadmill further comprises an intermediate member operably engageable with both the deck and the lever. The intermediate member could be movably positioned between the deck and the lever to alter cushion of the treadmill.

Another object of the present invention is to provide a cushioned treadmill which is capable of electronically modifying the cushion of the treadmill to accommodate the desires or running styles of different users. The treadmill further comprises a drive assembly for moving the position of the intermediate member. The drive assembly includes a cable loop, a drive member, and a drive motor which can move the position of the intermediate member via electronic control.

Independent features and independent aspects of the invention will become apparent to those skilled in the art upon review of the following detailed description, claims, and drawings, wherein like elements have like numerals throughout the drawings.

Figure 1:
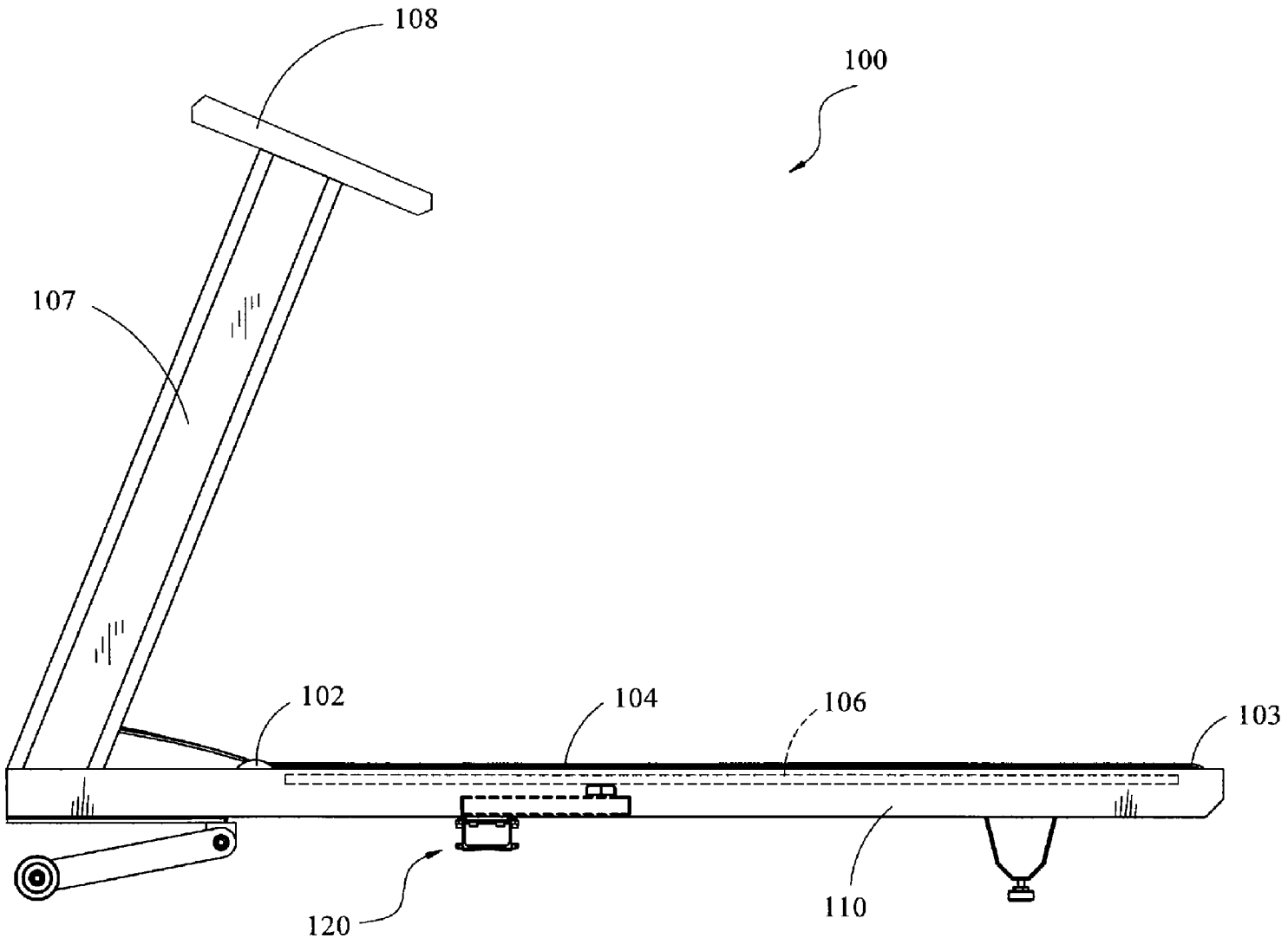
FIG. 1 is a side view of a treadmill having a cushion assembly embodying the present invention.

Before at least one independent embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting.

The use of "including", "having", and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIG. 1 illustrates a treadmill 100 with a cushion assembly 120 for providing cushion to a user as the user walks or runs on the treadmill 100. The treadmill 100 comprises a frame 110 adapted to rest on a floor surface. A forward roller 102 and a rear roller 103 are spaced and journalled in the frame 110. An endless belt 104 is trained on the rollers 102,103. The belt 104 has an upwardly-exposed exercise section extending longitudinally between the rollers 102, 103 and adapted to enable a user to exercise thereon. A console support 107 extends upward from the frame 110 and terminates with a console 108. The console 108 generally is for displaying information to a user of the treadmill 100 and allowing the user to select parameters of operating the treadmill 100 as the user desires. The rollers 102 and 103 are driven by an electronic motor (not shown), and the transmitting speed of the exercise section of the endless belt 104 is controlled by a user via the console 108.

A longitudinally-extending deck 106 is disposed underneath the exercise section of the belt 104. The deck 106 engages the underside of the exercise section of the belt 104 to support the exercise section of the belt 104 while a user exercises on the treadmill 100. Because the belt 104 is flexible, a user walking or running on the exercise section of the belt 104 can simultaneously cause a downward displacement of the belt 104 and the deck 106. The cushion assembly 120 is mounted on the frame 110 and is active between the deck 106 and the frame 110 to provide cushion to a user while the user is exercising on the treadmill 100. In addition to the cushion assembly 120, the deck 106 may be supported by a series of resilient supports (not shown), or it may be directly supported by the frame 110.

Figure 2:
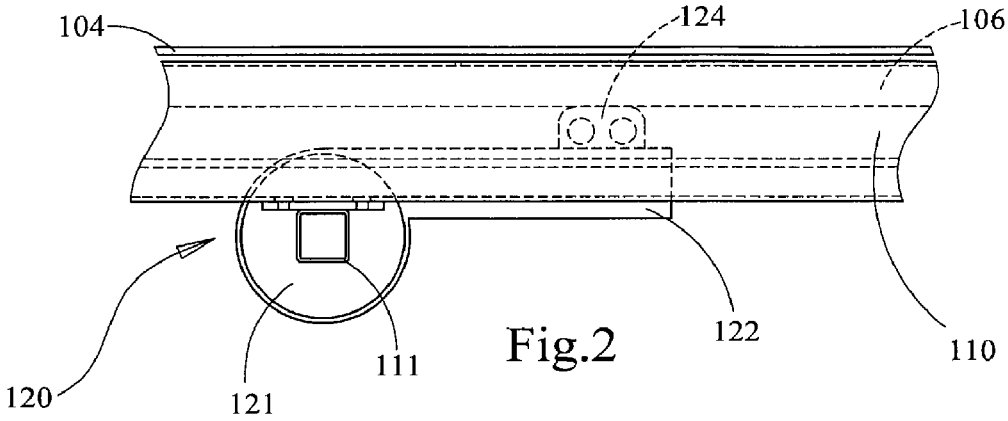
FIG. 2 is a side view of a simplified cushion assembly mounted underneath a treadmill.

FIG. 2 illustrates a simplified embodiment of a cushion assembly 120 mounted to the underside of a treadmill frame 110 and positioned under the deck 106. The cushion assembly 120 includes a lever 122, a resilient member 121, a support member 111, and an intermediate member 124. The support member 111 is fixedly connected to the underside of the frame 110. The support member 111 is surrounded by the resilient member 121, and the outer surface of the resilient member 121 is attached to one end of the lever 122. In this embodiment, the intermediate member 124 has been placed between the deck 106 and the lever 122, although it should be noted that the lever 122 could be designed to directly contact the deck 106.

This cushion assembly 120 is designed to resiliently resist vertical deflection of the deck 106. As the deck 106 is deflected downward, the intermediate member 124 transmits the downward deflection into the lever 122, which then rotates about the support member 111. Because the outer portion of the resilient member 121 is being rotated by the lever 122, and the inner portion of the resilient member 121 is being held stationary by the support member 111, the resilient member 121 is subjected to torsional loading. Because it is made of a resilient material, the resilient member 121 absorbs energy, dampens vibration, and resists rotation. Because of this resistance to rotation, the lever 122 resists the downward deflection of the deck 106.

Figure 3:
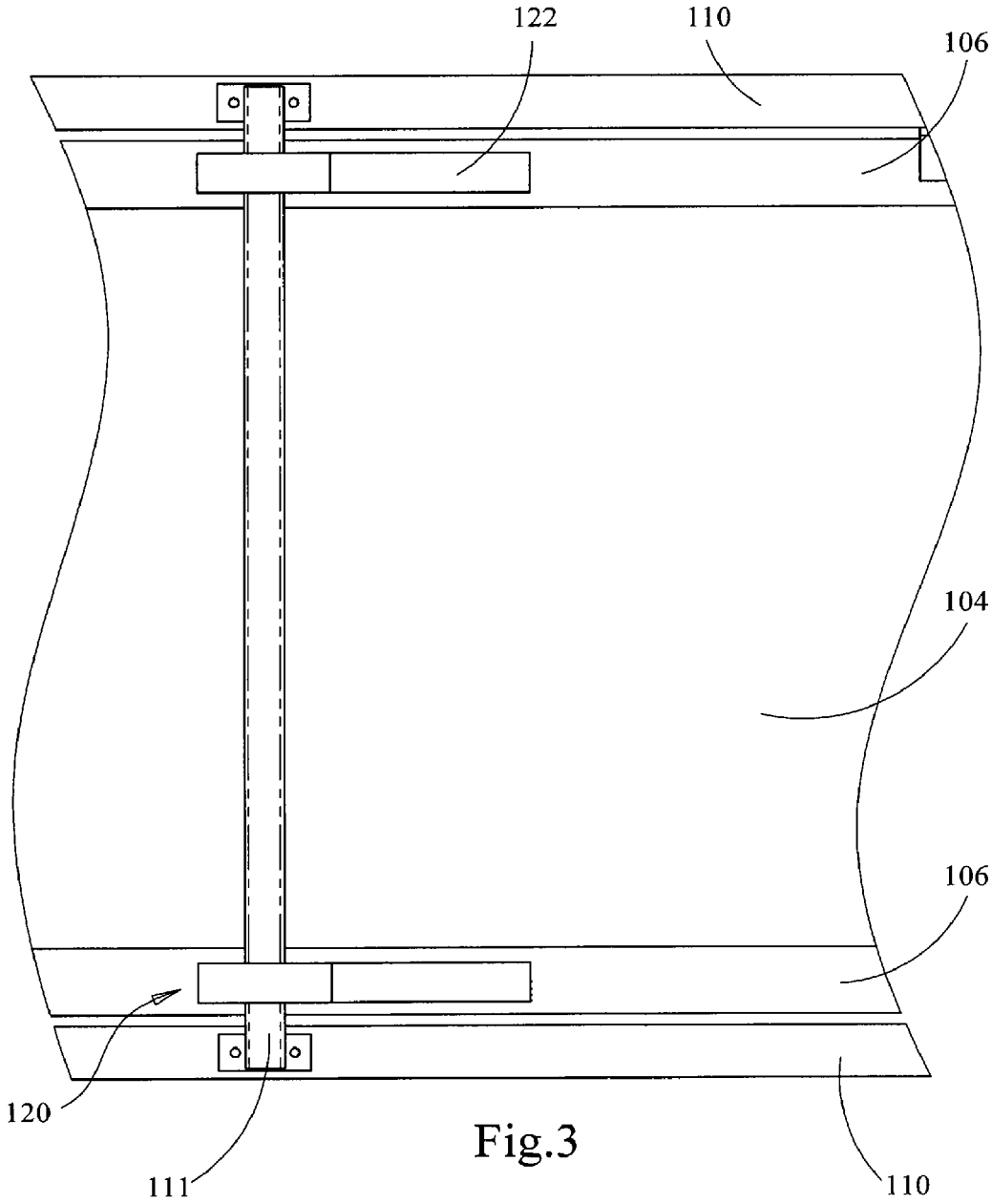
FIG. 3 is a bottom view of the cushion assembly shown in FIG. 2.

FIG. 3 illustrates the underside of a treadmill body, showing how the support member 111 is mounted to the treadmill frame 110, and how the levers 122 are positioned underneath the deck 106.

Figure 4:
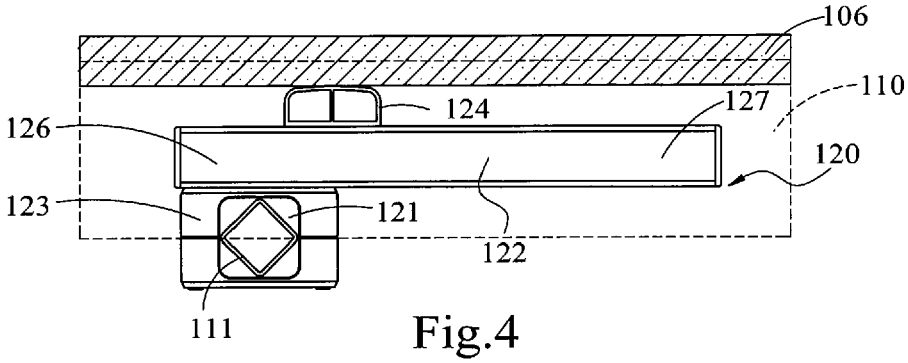
FIG. 4 is a side view of the cushion assembly of the treadmill shown in FIG. 1, showing an intermediate member near a rotatable coupling of the cushion assembly.

Referring to FIG. 4, the cushion assembly 120 of the treadmill 100 shown in FIG. 1 is illustrated. The cushion assembly 120 is positioned under the deck 106 and coupled to the frame 110 of the treadmill 100. The cushion assembly 120 includes a lever 122 having a first portion 127 and a second portion 126. The cushion assembly 120 also comprises a resilient member 121 having a portion operably coupled to the second portion 126 of the lever 122 and another portion coupled to the frame 110. It should be understood by people skilled in the art that the resilient member 121 could be a single cushion component, or could be a plurality of cushions working in combination to cushion the deck, absorb energy, dampen vibration, and/or resist displacement of the lever.

In this embodiment, the lever 122 further comprises a bracket 123 extending from the second portion 126 of the lever 122, and the frame 110 further comprises a support member 111 mounted thereon. The support member 111 is preferably a square tube which has four surfaces for engagement of the resilient member 121. It should be understood by people skilled in the art that the support member 111 could be in other polygon shapes, where the purpose of the polygon shape is to provide surfaces for engagement of the resilient member 121. Therefore, the second portion 126 of the lever 122 is rotatably coupled to the frame 110 and can have a rotational movement relative to the support member 111. More particularly, the resilient member 121 has a portion engaged or attached on the inner portion of the bracket 123 and another portion engaged on the outer portion of the support member 111. That is, the resilient member 121 is constrained and operably engaged with the bracket 123 and the support member 111 to provide resistance to the rotational movement of the second portion 126 of the lever 122. Materials for the resilient member 121 could be rubber, gel, fluid, spring, and so on, where the important characteristics of the material are its abilities to absorb energy, dampen vibration, resist displacement and/or provide resilience or cushioning. The illustrated cushion assembly 120 further comprises an intermediate member 124 positioned between the deck 106 and the lever 122. The intermediate member 124 is engaged with both the deck 106 and the lever 122. One of the purposes of the intermediate member 124 is to transmit the impact loads of a user from the deck 106 to the lever 122. The impact loads could also be transmitted to the lever 122 without having the intermediate member 124. For example, the lever 122 can have an extending portion from the first portion 127 to operably contact the deck 106.

Figure 5:
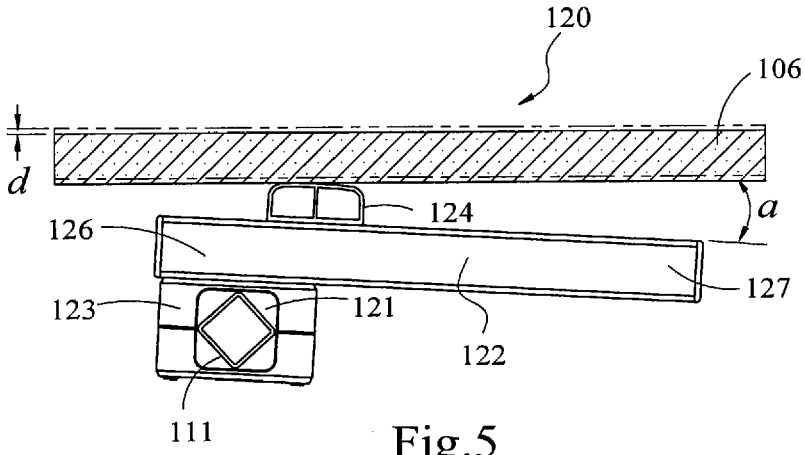
FIG. 5 is a side view of the cushion assembly shown in FIG. 4 in a displaced position.

Now referring to FIG. 5, a displacement d of the deck 106 and a rotating angle a of the lever 122 are illustrated. When a user exercises on the treadmill 100 shown in FIG. 1, there is a downward impact load acted on the belt 104 and the deck 106. The impact load causes the displacement d of the deck 106. The orientation of the displacement d is substantially vertical. Because the intermediate member 124 is engaged with the deck 106 and the lever 122, the displacement d of the deck 106 causes a corresponding downward movement of the intermediate member 124 which indirectly causes the rotational displacement of the second portion 126 of the lever 122. In other words, the substantially vertical deck displacement d is transmitted into a substantially rotational displacement a in the second portion 126 of the lever 122. Because the second portion 126 of the lever 122 has rotational movement relative to the frame 110, the resilient member 121 constrained inside the bracket 123 has a correspondent torsional deformation. The torsional deformation of the resilient member 121 provides resistance to the rotational movement of the lever 122 and ultimately provides cushion to a user of the treadmill 100. Different torsional coefficients of the resilient member 121 will cause different resistance to the rotational movement of the lever 122. Because the resilient member 121 is elastically deformed, it is not necessary for the lever 122 and the intermediate member 124 to have elastic characteristics. Even if the lever 122 and the intermediate member 124 are substantially rigid or stiff, the cushion assembly 120 can still provide sufficient cushion to a user of the treadmill 100.

In the embodiment shown in FIGS. 4 and 5, the intermediate member 124 is positioned close to the second portion 126 of the lever 122. The intermediate member 124 transmits the substantially vertical motion of the deck 106 to the lever 122, which causes rotation of the cushion assembly 120. FIG. 4 shows the lever 122 in its start position, and FIG. 5 shows the lever 122 in a displaced position.

Figure 6:
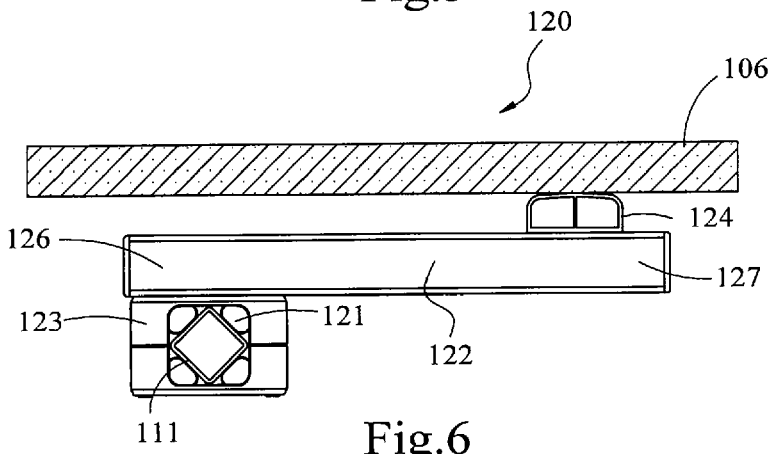
FIG. 6 is a side view of the cushion assembly shown in FIG. 4, showing the intermediate member farther from the rotatable coupling of the cushion assembly.
Figure 7:
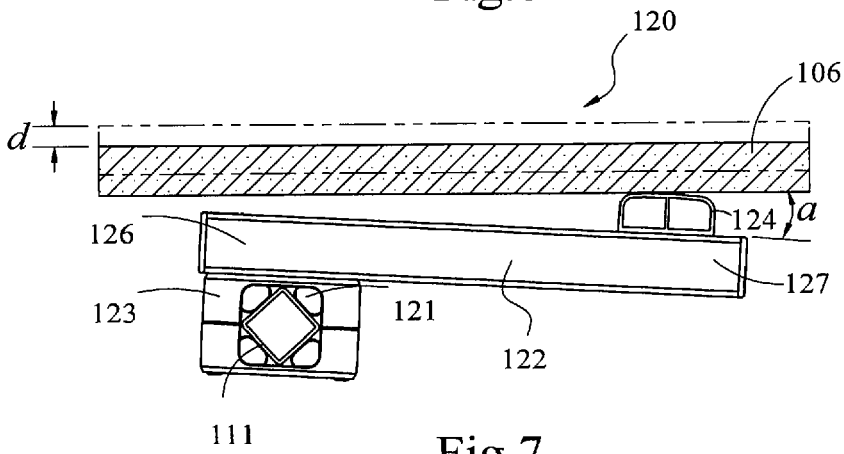
FIG. 7 is a side view of the cushion assembly shown in FIG. 6 in a displaced position.

FIGS. 6 and 7 illustrate the same embodiment of the cushion assembly 120 as is shown in FIGS. 4 and 5, but with the intermediate member 124 moved farther away from the second portion 126 of the lever 122. The intermediate member 124 transmits the substantially vertical motion of the deck 106 to the lever 122, which causes rotation of the cushion assembly 120. FIG. 6 shows the lever 122 in its start position, and FIG. 7 shows the lever 122 in a displaced position.

As shown in FIG. 7, the position of the intermediate member 124 is positioned much farther away from the second portion 126 of the lever 122. The rotating angle a can be the same as FIG. 5 but the displacement d of the deck 106 is significantly increased.

It can be assumed that the maximum downward force applied to the deck 106 by a user of the treadmill will remain a constant, regardless of the position of the intermediate member 124 on the lever 122. As shown in FIGS. 4 and 5, the intermediate member 124 is positioned close to the second portion 126 of the lever 122. Because of the short distance between the intermediate member 124 and the point of rotation of the lever 122, a very small displacement d causes a large change in angle a, which in turn causes the torque in the resilient member 121 to reach equilibrium with the torque created by the downward force of the deck 106 on the lever 122. In comparison, in FIGS. 6 and 7, the intermediate member 124 is positioned farther away from the second portion 126 of the lever 122. Because of this longer distance between the intermediate member 124 and the point of rotation of the lever 122, a larger change in angle a is needed before the torque in the resilient member 121 reaches equilibrium with the larger torque created by the downward force of the deck 106 on the lever 122. And because the change in angle a is greater, and the distance between the intermediate member 124 and the point of rotation is also larger, the linear displacement d of the deck is also larger. Therefore, the intermediate member 124 could be positioned at different positions along the lever 122 to modify the resistance to the displacement d of the deck 106. Looking at this design in another way, when the intermediate member 124 is positioned farther away from the second portion 126 of the lever 122, the resistance to the displacement d of the deck 106 is smaller and the cushion effect is soft. When the intermediate member 124 is positioned closer to the second portion 126 of the lever 122, the resistance to the deck 106 is greater and the cushion effect is hard.

Figure 8:
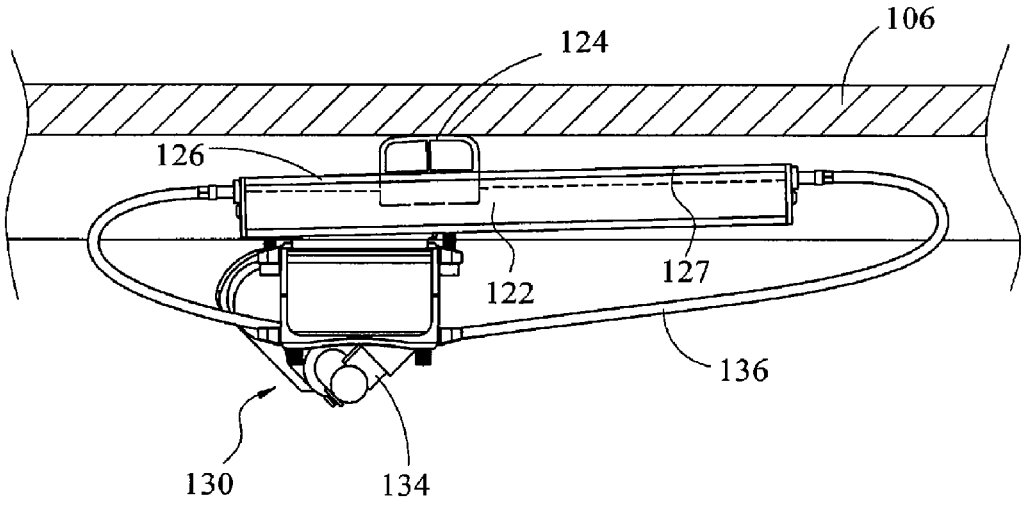
FIG. 8 is a side view of another embodiment of the cushion assembly of the present invention.
Figure 9:
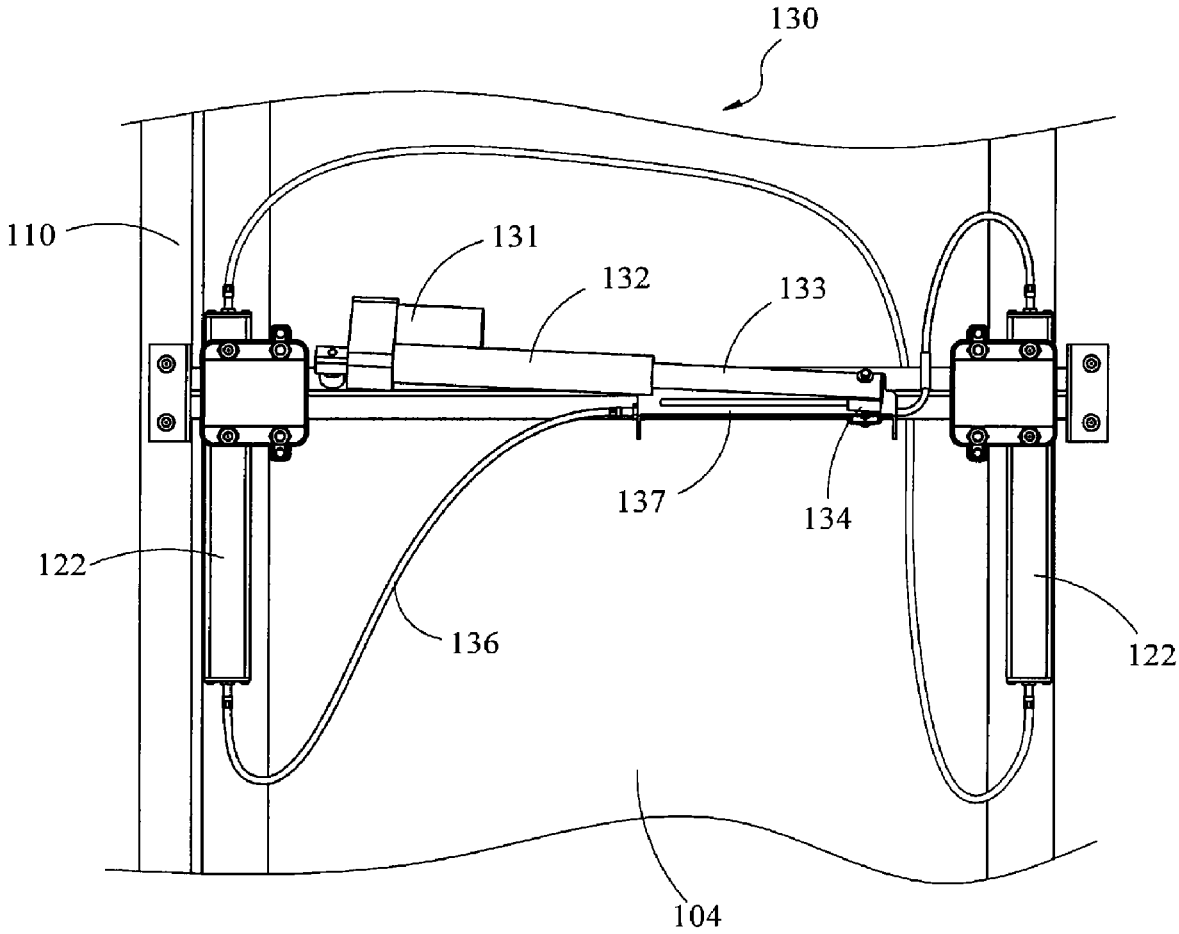
FIG. 9 is a bottom view of the cushion assembly shown in FIG. 8.
Figure 10:
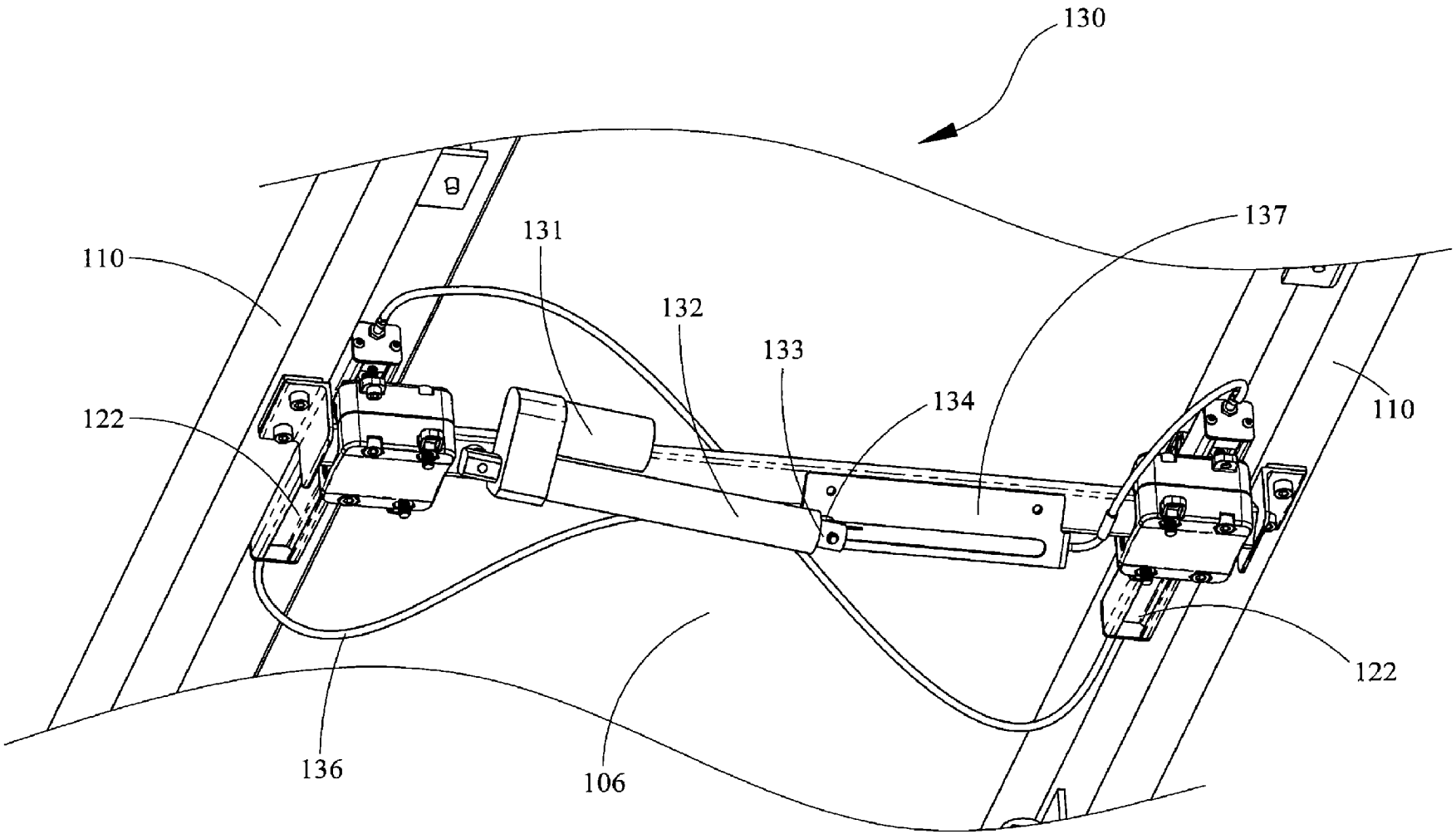
FIG. 10 is a perspective view of the cushion assembly shown in FIG. 8.

FIGS. 8-10 illustrate a drive assembly 130 for moving the position of the intermediate member 124 to modify the resistance to displacement of the deck 106. The driving assembly 130 includes a cable loop 136 and a drive member 134. A first portion of the cable loop 136 is connected to the intermediate member 124 as the broken line shown in FIG. 8, and a second portion of the cable loop 136 is connected to the drive member 134 as shown in FIG. 9. Because the cable loop 136 is in a loop arrangement, movement of the drive member 134 can be used to move the intermediate member 124 is either direction. Movement of the drive member 134 changes the position of the intermediate member 124 and provides different resistance to displacement of the deck 106. As shown in FIG. 10, the drive member 134 is moveably mounted on a guide 137 which is mounted on the frame 110. The drive assembly 130 further comprises a drive motor 131 mounted on the frame 110, a tube 132 extended from the drive motor 131, and a drive rod 133 coupled between the tube 132 and the drive member 134. Action of the drive motor 131 moves the drive member 134, which moves the cable loop 136 to change the position of the intermediate member 124. The use of the drive motor 131 provides a more convenient way to modify the resistance to displacement of the deck 106. In this embodiment, a user can electronically modify the cushion effect of the treadmill 100 via the console 108.

Figure 11:
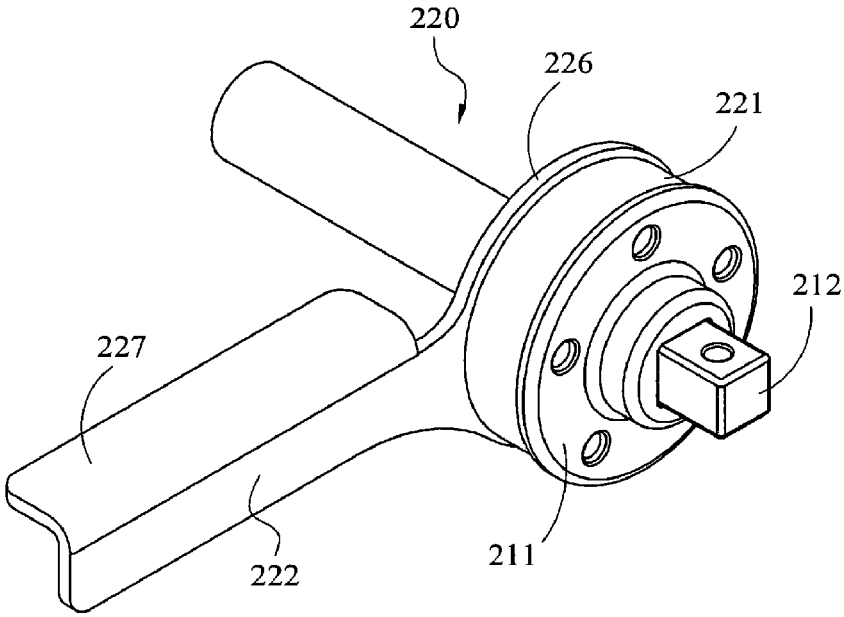
FIG. 11 is a rear perspective view of another embodiment of the cushion assembly of the present invention.
Figure 12:
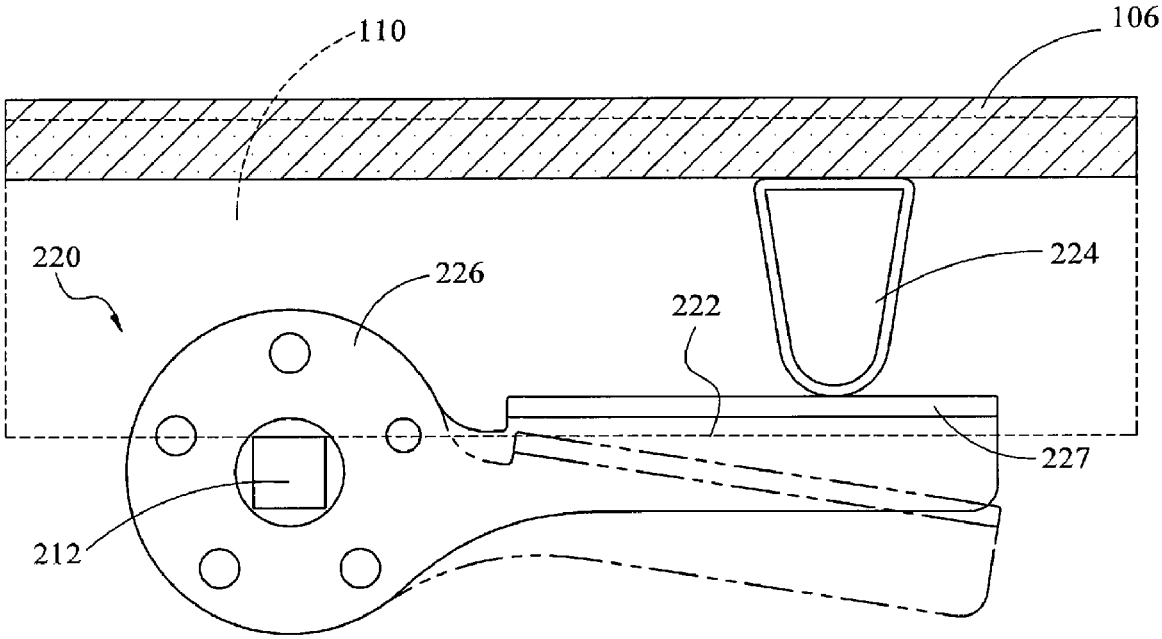
FIG. 12 is side view of the cushion assembly shown in FIG. 11.

FIGS. 11 and 12 illustrate a different embodiment of the present invention. The frame 110 as shown in FIG. 12 further comprises a rod 212 mounted thereon and a support member 211 fixedly mounted on one portion of the rod 212. A cushion assembly 220 is arranged between the support member 211 and the deck 106. The cushion assembly 220 comprises a resilient member 221 and a lever 222. The lever 222 has a first portion 227 and a second portion 226. The resilient member 221 has a first portion fixedly mounted on the second portion 226 of the lever 222 and a second portion fixedly mounted on the support member 211 which is part of the frame 110. Therefore, the second portion 226 of the lever 222 is rotatably coupled to the support member 211 via the resilient member 221. In this embodiment, the resilient member 221 is substantially cylindrical. As shown in FIG. 12, the second portion 226 of the lever 222 can rotate about the rod 212 while the first portion 227 of the lever 222 is rotated. Because both portions of the resilient member 221 are fixedly mounted, the resilient member 221 twists and elastically deforms to provide resistance to displacement of the deck 106 as the lever 222 is rotated. In this embodiment, an intermediate member 224 extends from the deck 106 as is shown in FIG. 12, or the intermediate member 224 could extend from the lever 222, similar to the arrangement of the intermediate member 124 disclosed in FIGS. 4-7. In other embodiments, intermediate members could also be omitted. That is, the first portion 227 of the lever 222 could directly contact the under side of the deck 106 without an intermediate member. The displacement of the deck 106 causes both rotation and displacement of the first portion 227 of the lever 222 and also causes elastic deformation of the resilient member 221 to provide resistance.

Figure 13:
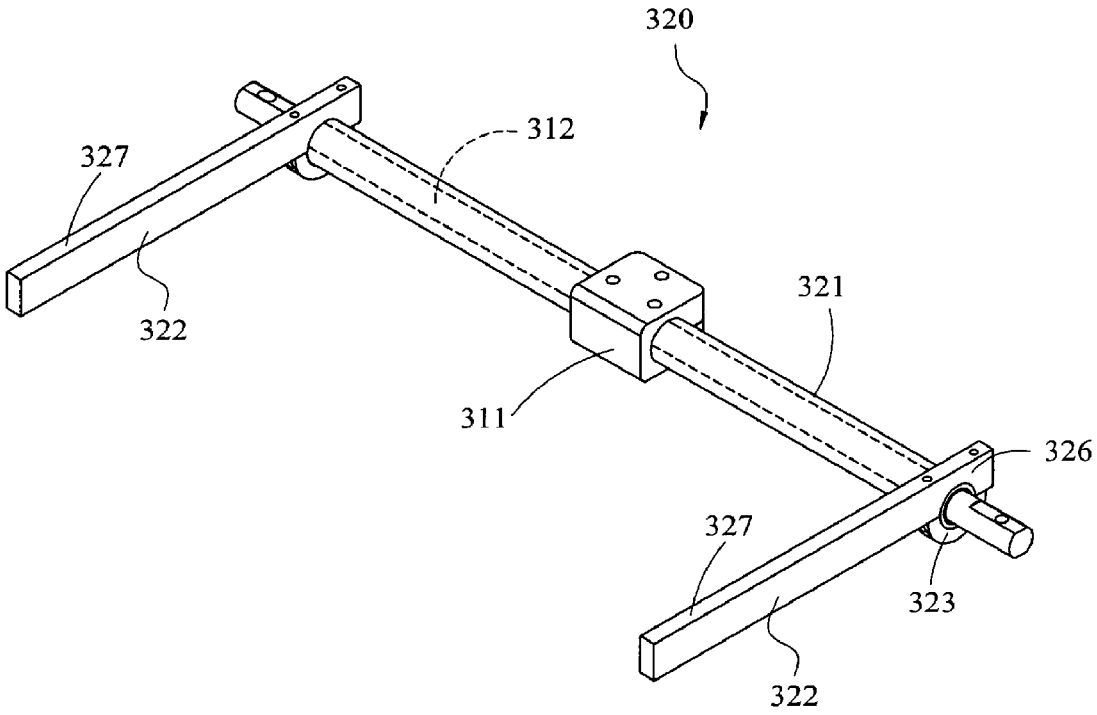
FIG. 13 is a rear perspective view of another embodiment of the cushion assembly of the present invention.

FIG. 13 illustrates another embodiment of the present invention. The design comprises a rod 312 mounted to the frame (not shown) and a support member 311 fixedly mounted on the central portion of the rod 312. A cushion assembly 320 is arranged for providing cushion to a user. The cushion assembly 320 comprises a resilient member 321 and a lever 322. The lever 322 has a first portion 327 and a second portion 326. The resilient member 321 has a first portion fixedly mounted on the second portion 326 of the lever 322 and a second portion fixedly mounted on the support member 311. When the lever 322 is rotated, the resilient member 321 is twisted and the second portion 326 of the lever 322 is rotated about the rod 312. The second portion 326 of the lever 322 further comprises a bracket 323 assembled to the second portion 326 of the lever 322 by screws. The purpose of the bracket 323 is for clamping the first portion of the resilient member 321 to the second portion 326 of the lever 322. Similar to the embodiment disclosed in FIG. 11, the resilient member 321 will be twisted and elastically deformed to provide resistance to displacement of the deck 106 as the lever 322 is rotated. The differences are that the resilient member 321 is laterally extended and is penetrated through and supported by the rod 312. The lateral extension of the resilient member 321 allows the shear stresses to be spread over a larger volume and could increase the maximum rotatable displacement available from this cushion assembly 320.

Figure 14:
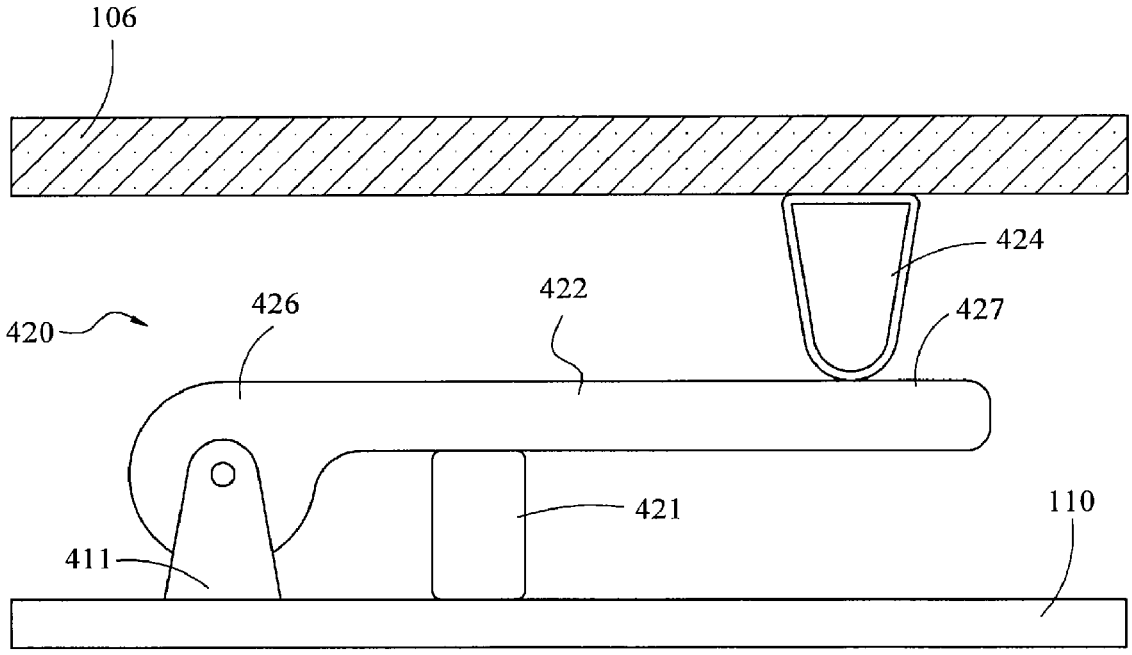
FIG. 14 is a side view of another embodiment of the cushion assembly of the present invention.

Now referring to FIG. 14, another embodiment of the present invention is illustrated. The frame as shown in FIG. 14 further comprises a support member 411 fixedly mounted thereon. A cushion assembly 420 is arranged to provide cushion to the deck 106. The cushion assembly 420 comprises a resilient member 421 and a lever 422. In this embodiment, the lever 422 has a first portion 427 and a second portion 426 which is pivoted to the support member 411. The resilient member 421 is mounted between the lever 422 and the frame 110. An intermediate member 424 is located between the deck 106 and the first portion 427 of the lever 422. The intermediate member 424 is substantially rigid and movable along the lever 422. Because the second portion 426 of the lever 422 is pivotally connected to the support member 411, the first portion 427 of the lever 422 will be rotated when the deck 106 suffers some downward displacement. The resilient member 421 is elastically compressed to provide resistance to the displacement of the deck 106. As mentioned previously, the position of the intermediate member 424 could be adjusted along the lever 422 to modify the resistance to displacement of the deck 106. In this embodiment, there are other ways to modify the resistance to displacement of the deck 106. It would also be possible to horizontally move the position of the resilient member 421 along the lever 422. When the resilient member 421 is positioned closer to the second portion 426 of the lever 422, the resistance to the deck 106 would be decreased and the cushion effect would be soft. The cushion effect would be hard when the resilient member 421 is positioned farther away from the second portion 426 of the lever 422. It would also be conceivable to have a stationary intermediate member 424 (or no intermediate member 424) and a stationary resilient member 421, and instead move the lever 422 and the support member 411 relative to the stationary resilient member 421 to increase or decrease the cushion effect.

Figure 15:
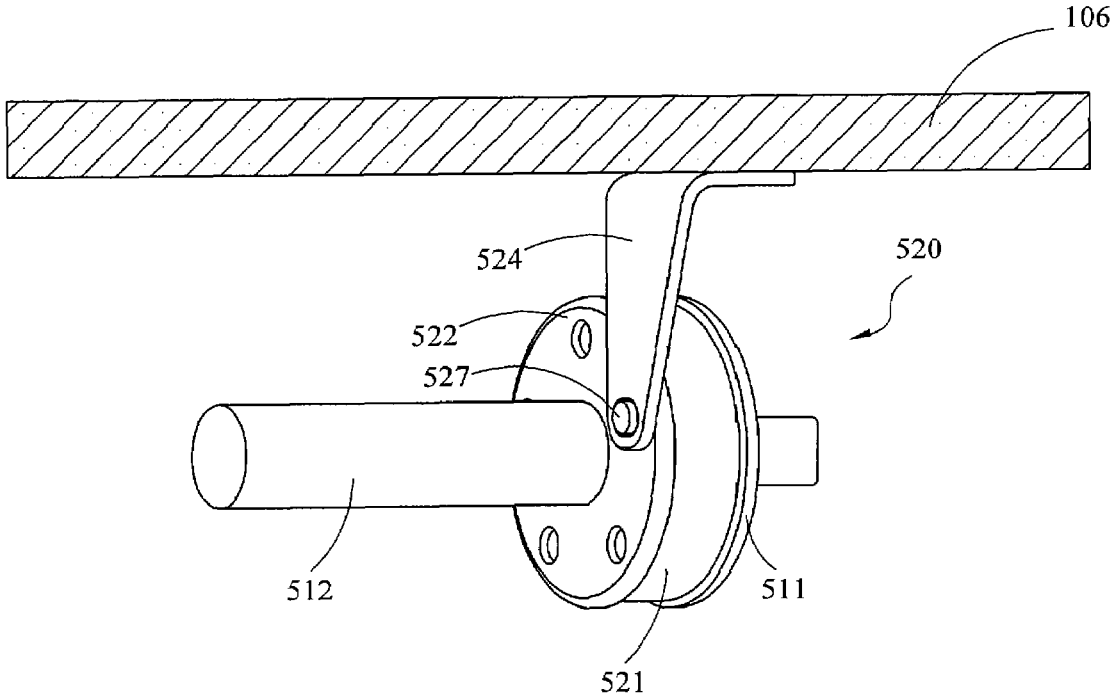
FIG. 15 is a rear perspective view of another embodiment of the cushion assembly of the present invention.
Figure 16:
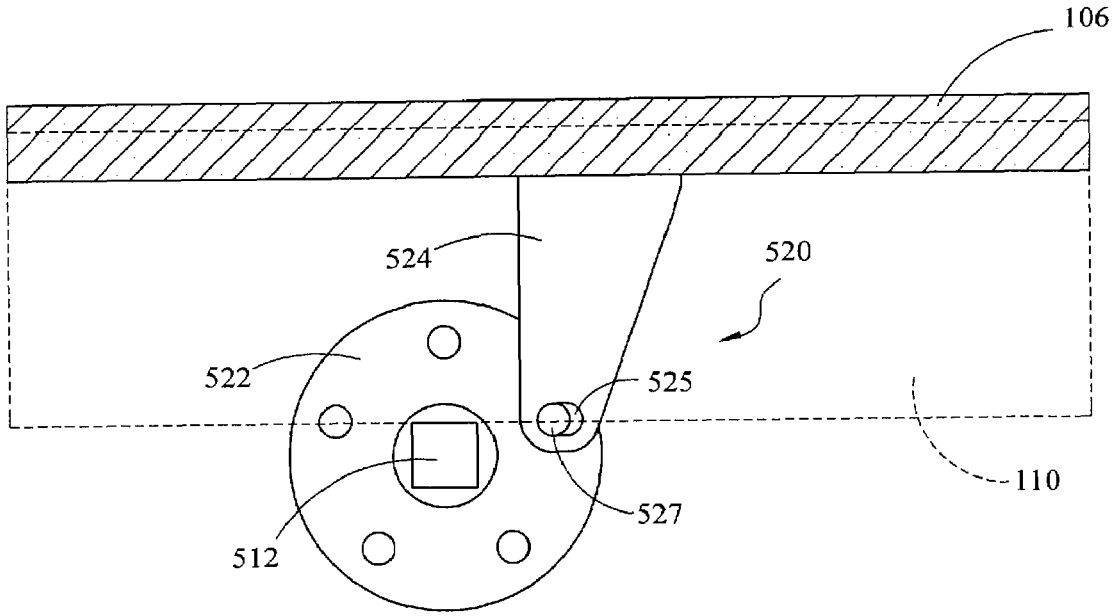
FIG. 16 is side view of the cushion assembly shown in FIG. 15.

FIGS. 15 and 16 illustrate another embodiment of the present invention. The frame 110 as shown in FIG. 16 further comprises a rod 512 mounted thereon and a support member 511 fixedly mounted on one portion of the rod 512. A cushion assembly 520 is arranged between the support member 511 and the deck 106. The cushion assembly 520 comprises a resilient member 521, an intermediate member 524, a pin joint 527, and a connection plate 522. The resilient member 521 has a first portion fixedly mounted to the connection plate 522 and a second portion fixedly mounted on the support member 511, which is part of the frame 110. The deck 106 is fixedly mounted to the intermediate member 524, which is pivotally connected to the connection plate 522 via the pin joint 527. Vertical displacement of the deck 106 is transmitted through the intermediate member 524 and the pin 527 into rotational displacement in the connection plate 522. Because both portions of the resilient member 521 are fixedly mounted, the resilient member 521 will be twisted and elastically deformed to provide resistance to displacement of the deck 106 as the connection plate 522 is rotated.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention.

The invention claimed is:

1. A treadmill, comprising:

(a) a frame;

(b) an endless belt trained on the frame;

(c) a deck disposed underneath the belt;

(d) a torsional resilient member having a first portion and a second portion, said first portion operably coupled to the frame and said second portion adapted to be rotated relative to said first portion; and (e) a substantially rigid lever having a first portion that is adapted to be rotated, and a second portion that is coupled to the second portion of the resilient member, wherein the first portion of the lever is operably coupled to the deck so that motion between the deck and the frame causes deflection of the first portion of the lever and rotation of the second portion of the lever, and wherein the resilient member resists rotation in at least one direction as the lever rotates relative to the frame;

wherein the frame further comprises a polygon support member, the torsional resilient member torsionally coupled to the lever and the polygon support member such that the torsional resilient member resists rotation of the lever around the polygon support member in at least one direction.

2. The treadmill of claim 1, further comprising an intermediate member operably engageable with both the deck and the first portion of the lever.

3. The treadmill of claim 2, wherein the intermediate member is substantially rigid.

4. The treadmill of claim 2, wherein the intermediate member is movably positioned between the deck and the lever.

5. The treadmill of claim 4, wherein the intermediate member is adapted to be positioned at any of a plurality of positions along the first portion of the lever.

6. The treadmill of claim 5, wherein the position of the intermediate member along the first portion of the lever modifies the resistance to displacement of the deck.

7. The treadmill of claim 6, further comprising a drive assembly for moving the position of the intermediate member.

8. The treadmill of claim 7, wherein the drive assembly comprises a cable loop and a drive member, the cable loop having a first portion connected to the intermediate member and a second portion connected to the drive member.

9. The treadmill of claim 8, the drive assembly further comprising a guide mounted on the frame to guide the drive member.

10. The treadmill of claim 9, the drive assembly further comprising a drive motor mounted on the frame and interconnected to the drive member.

11. The treadmill of claim 1, wherein the torsional resilient member is elastically deformed as the lever is being rotated.

12. The treadmill of claim 1, wherein the polygon support member is substantially a square tube.

13. The treadmill of claim 12, wherein the torsional resilient member is torsionally coupled to the lever and the square tube such that the torsional resilient member resists rotation of the lever about the square tube in at least one direction.

14. The treadmill of claim 1, wherein the torsional resilient member is substantially cylindrical, the torsional resilient member having a first portion fixedly mounted to the frame and a second portion fixedly mounted to the second portion of the lever such that the torsional resilient member resists rotation of the lever in at least one direction relative to the frame.

15. The treadmill of claim 14, the frame further comprising a second support member mounted on the polygon support member, both of which are mounted to the frame, wherein the torsional resilient member is penetrated through by the polygon support member, and wherein the first portion of the torsional resilient member is fixedly mounted to the second support member and the second portion of the resilient member can rotate relative to the polygon support member.

16. A treadmill, comprising:

(a) a frame;

(b) an endless belt trained on the frame;

(c) a deck disposed underneath the belt;

(d) a torsional resilient member having a first portion and a second portion, said first portion operably coupled to the frame and said second portion adapted to be rotated relative to said first portion;

(e) a substantially rigid lever having a first portion that is adapted to be rotated, and a second portion that is coupled to the second portion of the resilient member, wherein the first portion of the lever is operably coupled to the deck so that motion between the deck and the frame causes deflection of the first portion of the lever and rotation of the second portion of the lever, and wherein the resilient member resists rotation in at least one direction as the lever rotates relative to the frame;

(f) an intermediate member operably engageable with both the deck and the first portion of the lever, wherein the intermediate member is movably positioned between the deck and the lever, wherein the intermediate member is adapted to be positioned at any of a plurality of positions along the first portion of the lever, and wherein the position of the intermediate member along the first portion of the lever modifies the resistance to displacement of the deck; and (g) a drive assembly for moving the position of the intermediate member, wherein the drive assembly comprises a cable loop and a drive member, the cable loop having a first portion connected to the intermediate member and a second portion connected to the drive member.

17. The treadmill of claim 16, the drive assembly further comprising a guide mounted on the frame to guide the drive member.

18. The treadmill of claim 17, the drive assembly further comprising a drive motor mounted on the frame and interconnected to the drive member.

* * * * *